United States Patent [19]

Kamegaya et al.

[11] 4,393,326

[45] Jul. 12, 1983

[54] DC PLASMA DISPLAY PANEL

[75] Inventors: Takeo Kamegaya, Tokyo; Satoshi Watanabe, Saitama, both of Japan

[73] Assignee: Okaya Electric Industries Co., Ltd., Tokyo, Japan

[21] Appl. No.: 236,379

[22] Filed: Feb. 20, 1981

[30] Foreign Application Priority Data

| | | | |
|---|---|---|---|
| Feb. 22, 1980 | [JP] | Japan | 55-21789 |
| Feb. 22, 1980 | [JP] | Japan | 55/21790 |
| Jan. 12, 1981 | [JP] | Japan | 56/2838 |

[51] Int. Cl.[3] ..... H01J 61/06

[52] U.S. Cl. ..... 313/582; 313/346 R; 313/630; 445/24

[58] Field of Search ..... 313/318, 217, 218, 346 R; 316/1; 29/25.11

[56] References Cited

U.S. PATENT DOCUMENTS

| | | | |
|---|---|---|---|
| 3,697,793 | 10/1972 | King | 313/218 X |
| 3,943,394 | 3/1976 | Ernthausen | 313/218 X |
| 4,340,840 | 7/1982 | Aboelfotoh et al. | 313/218 X |

*Primary Examiner*—Eugene La Roche

*Attorney, Agent, or Firm*—Sughrue, Mion, Zinn, Macpeak and Seas

[57] ABSTRACT

A plasma display panel with an electrode composed of a metal layer (e.g., Fe and Ni) and a metal compound layer (e.g., alkaline earth metal oxide or sulfide, and rare earth metal hexaborides) which are formed by means of plasma spray coating. The plasma spray coating should be done at such a temperature that the metal or metal compound is in the molten state.

11 Claims, 9 Drawing Figures

DC PLASMA DISPLAY PANEL

BACKGROUND OF THE INVENTION

The present invention relates to a DC plasma display panel and more particularly to a DC plasma display panel having electrodes formed by plasma spray coating.

Electrodes for use in conventional DC plasma display panels (hereinafter referred to as "DC—PDP's") have been produced, for example, by forming an about 75 to 100μ thick layer of an alloy of Fe and Ni, an alloy of Fe, Ni and Cr (e.g., a 42-6 alloy) or the like by etching, electroless plating, electroplating, deposition, or by printing using a thick film printing technique on an insulative substrate such as a glass plate or a ceramic plate. These conventional electrode-producing methods, however, have a number of disadvantages. For example, with an electrode produced by etching, registration problems arise which creates difficulties in assembling a panel because the number of parts is large. Moreover, electrodes produced by the other methods are poor in bonding among metal particles. In particular, electrodes produced by deposition or plating are poor in durability because such methods can not produce electrodes of sufficient thickness.

Hereinafter, a prior art plasma display panel will be explained in detail with reference to FIGS. 1A and 1B of the accompanying drawings. Referring to FIG. 1A, the prior art plasma display panel includes a front glass plate 1, an electrode (anode) 2 provided on the inner surface of the front glass plate 1, a spacer 3 forming discharge cells 4, a rear glass plate 5, and an electrode (cathode) 6 provided on the inner surface of the rear glass plate 5. The cathode 6 is provided in a layer form using procedures such as thick film printing using a Ni paste, deposition, or plating. The electrode provided by such procedures suffers from the problem that the bonding among metal particles is poor. Furthermore, the electrode provided by thick film printing has the disadvantage that its physical strength is poor, and the electrodes provided by deposition, plating, etc. have the disadvantage that their durability as a cathode is poor because the thickness thereof is limited.

A plasma display panel as illustrated in FIG. 1B includes a front glass plate 1, a cathode 6 in the form of a ribbon, a spacer 3 forming discharge cells 4, a rear glass plate 5, and a linear anode 2 disposed on the rear glass plate 5. In order to provide a sufficient durability, the cathode 6 is produced in the form of a ribbon from a metal plate, such as a 42-6 alloy plate, having a thickness of about 75μ using an etching technique. This method, however as described hereinbefore, has the disadvantage that registration creates difficulties in assembling a panel because the number of parts is large.

Electrode materials such as Fe, Ni and Cr which have heretofore been used have work functions of about 4.5 eV which is relatively large for use as a cathode for DC-PDP's. Moreover, these materials required relatively high operating voltages of about 300 V. An operating voltage of this magnitude makes the power consumption of a DC-PDP correspondingly high.

In order to reduce this power consumption, it has been proposed to use substances having small work functions as electrode materials. Of such materials, hexaborides of rare earth elements (e.g., $LaB_6$ and $CeB_6$) have the following characteristics:

(a) The work function is small, for example, 2.7 eV for $LaB_6$.

(b) The melting point is high, for example, 2600° C. for $LaB_6$.

(c) The electrical conductivity is good.

(d) There is little abrasion due to ion impact.

Of these characteristics, (a) the low work function, (c) the good electric conductivity, and (d) the small amount of abrasion from ion impact are desirable properties for a cathode material. However, it is very difficult to deposit a hexaboride of a rare earth element on a cathode substrate of DC-PDP because of (b) the high melting point. For example, where the hexaboride is converted into the form of an ink and coated on an electrode substrate with a usual printing method, the adhesive force is low because of the very high melting point and sintering temperature of the hexaboride and hence firm adhesion cannot be obtained. Addition of a binder may deteriorate the discharge characteristics. Furthermore, with a DC-PDP having a regular structure, high temperature heat processing may result in deformation of the panel. For these reasons, high melting point materials have not been used in practice for electrode materials.

SUMMARY OF THE INVENTION

An object of the present invention is thus to provide a DC—plasma display panel having a low operating voltage and power consumption.

Another object of the invention is to provide a DC—plasma display panel having a cathode which has a high abrasion resistance to ion impact and which has a high durability.

These objects are attained with a method of depositing a material having a small work function on the surface of a cathode substrate layer by plasma spray coating using a rare gas discharge plasma jet apparatus and a plasma display panel produced using this method. The invention provides a plasma display panel having an electrode composed of a metal layer or a metal alloy layer which is produced by plasma spray coating.

More specifically, the invention provides a plasma display panel composed of the cathode substrate layer upon which is deposited a metal compound layer having the small work function which is formed on the cathode substrate layer by plasma spray coating. The plasma spray coating should be done at such a temperature that the metal compound is molten. The metal compound layer is preferably deposited on the cathode substrate layer formed of a material such as Fe, Ni, W, Cu, Cr or Al or a metal alloy of any kind. For a metal compound layer, it may be a material such as alkaline earth metal oxides, alkaline earth metal sulfides, aluminum composite metal oxides, or rare earth hexaborides. The metal compound layer should have a thickness in the range of about 1 to 50μ.

DESCRIPTION OF THE PREFERRED EMBODIMENTS

Hereinafter, the invention will be explained in greater detail with reference to preferred embodiments as illustrated in the accompanying drawings.

Figure 1A:
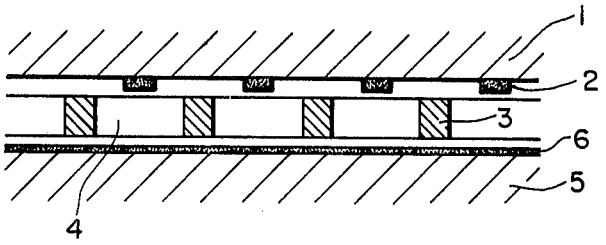
FIG. 1A PRIOR ART
FIGS. 1A and 1B are schematic sectional views of a plasma display panel having an electrode which is produced by a prior art method.
Figure 1B:
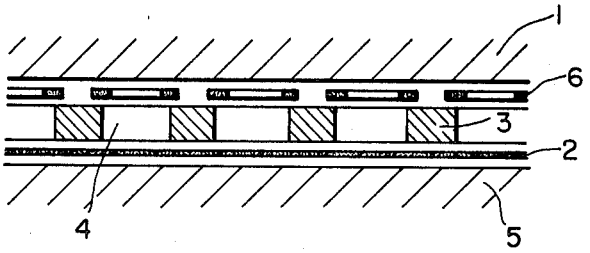
FIG. 1B PRIOR ART
Figure 2A:
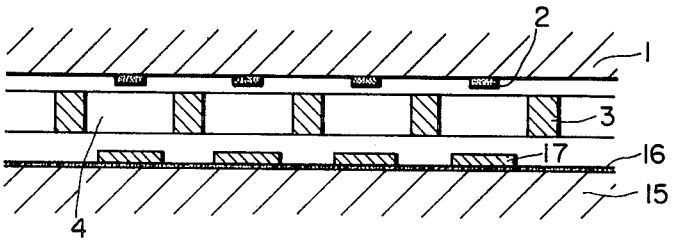
FIGS. 2A and 2B are a schematic sectional view and a partial perspective view, respectively, of a plasma display panel in which an electrode is produced by plasma spray coating according to a first preferred embodiment of the invention.
Figure 2B:
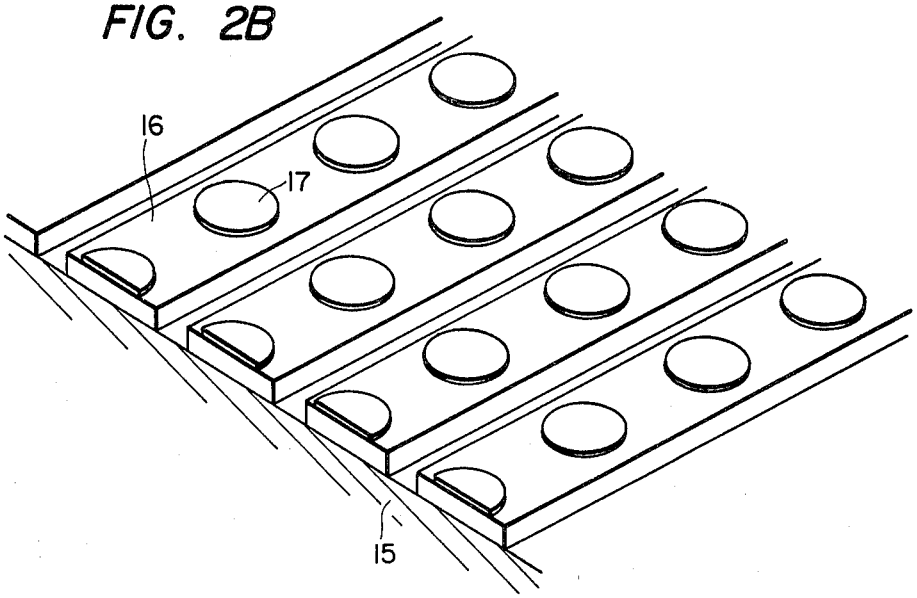

Referring to FIGS. 2A and 2B, a plasma display panel of a first embodiment of the invention includes a front glass plate 1, an anode 2 provided on the inner surface of the front glass plate 1, a spacer 3 forming discharge cells 4, a cathode 16 provided on the inner surface of a rear glass plate 15 facing the anode 2, and an emitter 17 provided on the cathode 16 facing the discharge cell 4. The cathode 16 is formed of either a pure metal such as Fe, Ni, W, Cu, Cr or Al or a metal alloy such as Fe-Ni and is formed by plasma spray coating. In this case, techniques heretofore used such as etching, thick film printing, plating, and deposition, may be employed.

On the cathode 16 facing the discharge cell 4 are deposited regions of a material having a small work function by plasma spray coating. These regions, which have a thickness of about 1 to 50$\mu$ and preferably 10 50$\mu$, form the emitter 17. With the cathode 16 produced by plasma spray coating wherein metal powder is melted, the thickness can be increased to the extent desired and it is possible to provide a cathode having a thickness up to 300$\mu$ or more. The cathode thus formed has a good durability. In the plasma display panel of the invention, however, the thickness of the cathode 16 need be only about 1 to 50$\mu$.

Preferred examples of materials having small work functions which can be used in forming the emitter 17 are (1) oxides of alkaline earth metals such as BaO, (2) sulfides of alkaline earth metals such as BaS, (3) composite metal oxides of alkaline earth metals and aluminum, and (4) hexaborides of rare earth elements such as $LaB_6$ and $CeB_6$.

Although it is not possible to continuously obtain a discharge current from an electrode formed from the above materials (1), (2) or (3) because they are inherently electrically insulative, plasma spray coating using a plasma jet apparatus through which an inert gas such as a rare gas is passed, permits the temperature in the plasma to be set to several thousand or several ten thousand degrees (°C.) thereby to easily melt the above materials (1), (2) and (3). Furthermore, the material can be blown onto the surface of a cathode substrate metal and be adhered thereto in a molten state. Thus, it is not necessary to carry out high temperature heat processing for the plasma display panel formed by plasma spray coating.

Figure 6A:
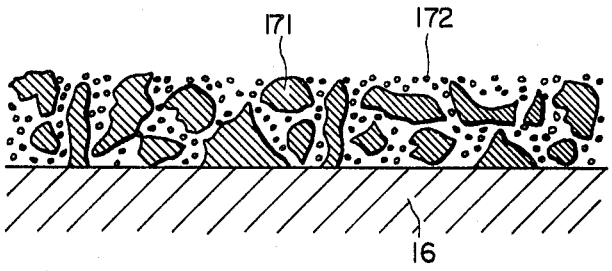
FIGS. 6A and 6B are enlarged sectional views of the surface of a cathode produced with the invention.

FIG. 6A is an enlarged sectional view of an alkaline earth metal compound layer provided on the surface of a cathode substrate metal by the above-described plasma spray coating method. Reference numerals 16, 171 and 172 indicate, respectively, a cathode substrate metal, alkaline earth metal compound particles which are molten-adhered, and smaller free alkaline earth metal particles. Alkaline earth metal compound particles 171 molten-adhere onto the surface of the substrate metal 16 lying one upon another thereby forming a porous layer. The smaller alkaline earth metal particles 172 are present between such alkaline earth metal compound particles 171. Thus, a current can be continuously obtained although the alkaline earth metal compound 171 is electrically insulative. Into the porous layer composed of the alkaline earth metal compound particles 171 and free alkaline earth metal particles 172 may be incorporated a metal (electric conductor) having a small work function by a suitable method.

In depositing oxide or sulfides of alkaline earth metals or composite metal oxides of such alkaline earth metals and aluminum onto the substrate metal by plasma spray coating, elemental Mg or $MgCO_3$, for example, is converted into MgO by oxidation or decomposition. Thus, these compounds are suitable for use with the invention. Also contemplated within the scope of the invention are those compounds which are converted into oxides or sulfides of alkaline earth metals or composite metal oxides of such alkaline earth metals and aluminum by such plasma spray coating.

Figure 6B:
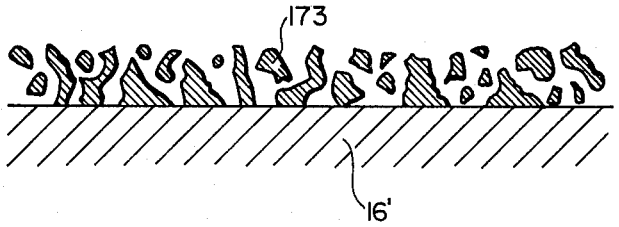

Hexaborides of rare earth elements are electrically conductive and they moreover form a porous layer when molten-adhered onto the surface of the cathode substrate metal by the plasma spray coating method. FIG. 6B shows a rare earth metal hexaboride layer in which the reference numerals 16' and 173 indicate, respectively, a cathode substrate metal and a rare earth metal hexaboride.

Figure 3:
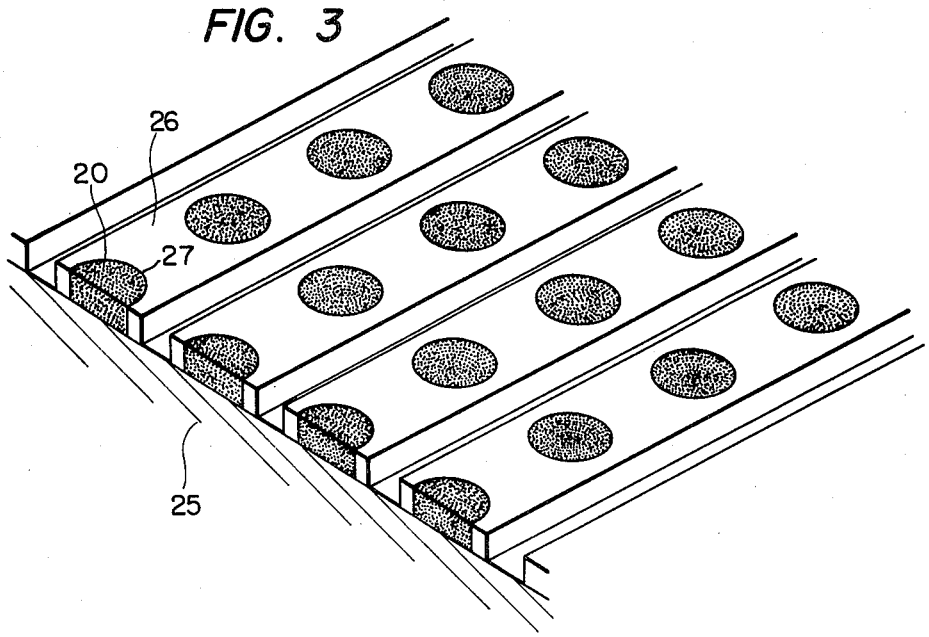
FIGS. 3 to 5 are partial sectional views of a plasma display panel in which an electrode is produced by plasma spray coating according to a second preferred embodiment of the invention.

FIG. 3 shows a cathode structure of a plasma display panel according to a second embodiment of the invention. In this embodiment, a plurality of ribbon-like metal cathode strips 26 are provided on a rear glass plate 25 and are cut at suitable intervals to form holes 20. An emitter substance having a small work function as described hereinbefore is deposited in the holes 20 by plasma spray coating to form therein an emitter 27. The cathode substrate metal and the emitter 27 are designed so that they have a substantially even upper surface.

Figure 4:
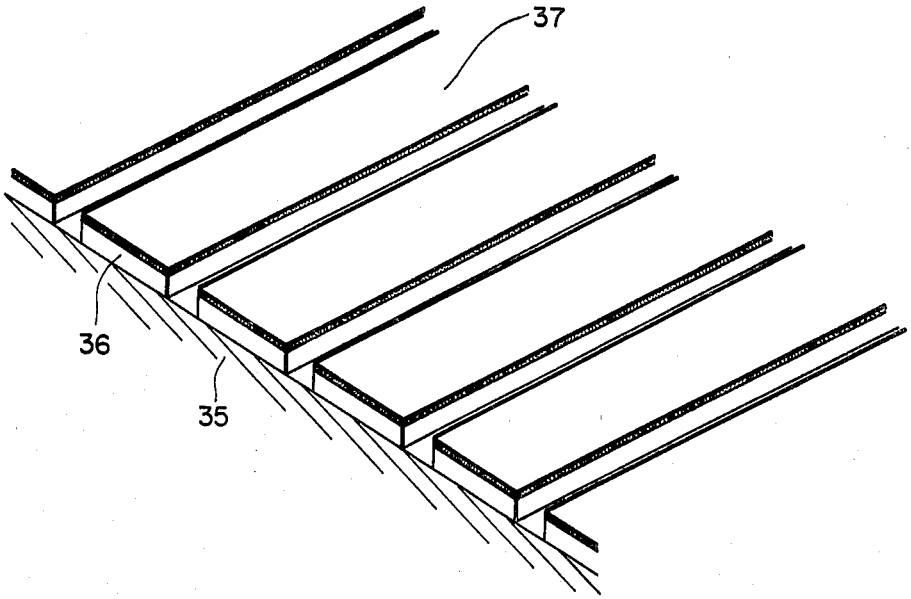

FIG. 4 shows a cathode structure of a plasma display panel according to a third embodiment of the invention. In this embodiment, a plurality of ribbon-like metal cathode strips 36 are provided on a rear glass plate and an emitter 37 is formed on the surface of the ribbon-like metal cathode strips 36 by plasma spray coating.

Figure 5:
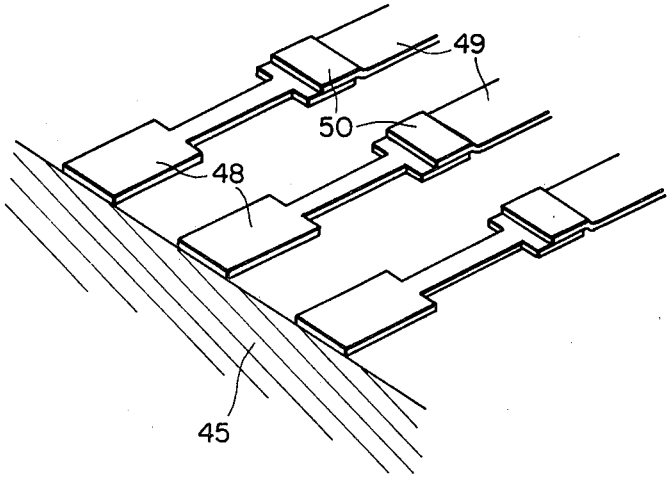

In a fourth embodiment of the invention as shown in FIG. 5, a conductor pattern 48 is provided on a rear glass plate 45 by plasma spray coating and a cathode pattern 49 is provided and connected to the conductor pattern 48 through a connection portion 50 formed by plasma spray coating. The conductor pattern 48 may be provided by techniques such as etching, thick film printing, plating, and deposition.

With a cathode having the structure described employed in DC—PDP, ions of gas in the tube strike against the foregoing compound having a small work function causing it to emit electrons. Thus the panel can be stably operated at as low a voltage as about 100 V. If the thickness of the compound layer is too small, abrasion by ion impact is significant and the service life of the panel is accordingly reduced. On the other hand, if the thickness is too large, it is not possible to reduce the spacing of discharge cells of the plasma display panel because the compound layer is provided on a thin substrate metal. In practical use, therefore, the thickness of the compound layer is suitably in a range of from about 1 to 50$\mu$.

The invention is applicable to any type of DC-PDP so long as it has a flat structure. For example, for producing a character display panel wherein electrodes are constructed in a matrix form or a bar graph display panel wherein strip-like electrodes are formed parallel to each other, a uniform cathode layer of the invention can be used.

Although the above description specifically refers to the use of plasma spray coating as a spraying method, the invention is not limited thereto and any method having the same effects as the plasma spray coating can be used.

In accordance with the invention, as described above, a DC—PDP having a significantly smaller operating voltage and power consumption smaller than that of a conventional panel can be easily produced by the use of an oxide or sulfide of an alkaline earth metal, a composite metal oxide of such an alkaline earth metal and aluminum, or a hexaboride of a rare earth metal, having a small work function, little abrasion due to ion impact, and a high melting point, in a cathode substrate in the form of a porous layer, for example, by plasma spray coating, without application of any specific high temperature treatment. The invention, therefore, produces many advantages. For example, direct implementation in LSI is possible.

What is claimed is:

1. A DC plasma display panel comprising first and second substrates defining a gas chamber therebetween; an ionizable gaseous medium within said chamber; an anode layer formed onto said first substrate; a cathode layer formed onto said second substrate; an emitter layer formed onto said cathode layer; said cathode layer, said emitter layer, and said anode layer being disposed within said chamber for ionizing said gaseous medium; said emitter layer being formed onto said cathode layer by plasma spray coating.

2. The plasma display panel of claim 1 wherein said cathode layer is made from a metal selected from the group consisting of Fe, Ni, W, Cu, Cr and Al.

3. The plasma display panel of claim 1 wherein said cathode layer is made from a metal alloy.

4. The plasma display panel of any of claims 1, 2 or 3 wherein said cathode layer is formed by plasma spray coating.

5. The plasma display panel of any of claims 1, 2 or 3 wherein said emitter is made from a compound selected from the group consisting of alkaline earth metal oxides, alkaline earth metal sulfides, aluminum composite metal oxides, and rare earth metal hexaborides.

6. The plasma display panel of any of claims 1, 2 or 3 wherein said emitter has a thickness in the range of 1 to 50$\mu$.

7. The plasma display panel of claim 5 wherein said plasma spray coating is performed at a temperature sufficiently high to melt the material of said emitter.

8. The DC plasma display panel of claim 1, wherein said emitter layer comprises a plurality of discrete emitters and said anode layer comprises a plurality of discrete anodes, said emitters and said anodes defining a plurality of gas discharge cells therebetween.

9. The DC plasma display panel of claim 1, wherein said cathode layer is in the form of at least one strip.

10. The DC plasma display panel of claim 9, wherein said emitters are formed as a plurality of disc-shaped regions onto said cathode layer.

11. The DC plasma display panel of claim 10, wherein said cathode layer has a plurality of substantially circular apertures formed therein and wherein said emitters are provided within said apertures.

* * * * *